US010121425B2

(12) United States Patent
Ahn et al.

(10) Patent No.: US 10,121,425 B2
(45) Date of Patent: Nov. 6, 2018

(54) ADAPTIVE BLACK CLIPPING CIRCUIT, DISPLAY DEVICE INCLUDING THE SAME AND ADAPTIVE BLACK CLIPPING METHOD

(71) Applicant: Samsung Display Co., Ltd., Yongin (KR)

(72) Inventors: Ik-Hyun Ahn, Hwaseong-si (KR); Yoon-Gu Kim, Seoul (KR); Woo-Joo Lee, Seoul (KR); Bong-Im Park, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 330 days.

(21) Appl. No.: 14/825,376

(22) Filed: Aug. 13, 2015

(65) Prior Publication Data

US 2016/0118001 A1 Apr. 28, 2016

(30) Foreign Application Priority Data

Oct. 24, 2014 (KR) ..... 10-2014-0145408

(51) Int. Cl.
*G09G 3/36* (2006.01)
*G09G 3/34* (2006.01)

(52) U.S. Cl.
CPC ..... *G09G 3/3614* (2013.01); *G09G 3/3406* (2013.01); *G09G 3/3607* (2013.01); *G09G 3/3648* (2013.01); *G09G 3/3696* (2013.01); *G09G 2310/0251* (2013.01); *G09G 2310/0286* (2013.01); *G09G 2320/0209* (2013.01); *G09G 2320/0242* (2013.01);

(Continued)

(58) Field of Classification Search
None
See application file for complete search history.

(56) References Cited

U.S. PATENT DOCUMENTS 6,396,465 B1 * 5/2002 Nakagiri ..... G09G 3/2003 345/600
2005/0001802 A1 * 1/2005 Lee ..... G09G 3/3648 345/89

(Continued)

FOREIGN PATENT DOCUMENTS

KR 10-2011-0111864 10/2011
KR 10-2013-0057704 6/2013

(Continued)

*Primary Examiner* — Aneeta Yodichkas
(74) *Attorney, Agent, or Firm* — H.C. Park & Associates, PLC

(57) ABSTRACT

An adaptive black clipping circuit in a display device includes a data corrector, a register, a pattern detector and a clipping selector. The data corrects input image data to generate corrected image data such that the corrected image data is equal to or greater than a black clipping value where the black clipping value corresponds to the input image data having a grayscale value of zero and the black clipping value is greater than zero. The register stores and provides configuration data. The pattern detector generates a pattern detection signal based on the input image data corresponding to a plurality of rows. The clipping selector selects one of the corrected image data and the configuration data in response to the pattern detection signal to provide output image data.

18 Claims, 16 Drawing Sheets

(52) U.S. Cl.
CPC ..... *G09G 2320/0271* (2013.01); *G09G 2320/043* (2013.01); *G09G 2320/066* (2013.01)

(56) References Cited

U.S. PATENT DOCUMENTS

| | | | | |
|---|---|---|---|---|
| 2008/0231616 | A1* | 9/2008 | Kim ..... | G09G 3/3614 345/204 |
| 2015/0035866 | A1 | 2/2015 | Ahn et al. | |

FOREIGN PATENT DOCUMENTS

| | | |
|---|---|---|
| KR | 10-2013-0079950 | 7/2013 |
| KR | 10-2015-0010844 | 1/2015 |

* cited by examiner

311

| IN | OUT | | |
|---|---|---|---|
| | R | G | B |
| 0 | R_CL | G_CL | B_CL |
| 1 | R1 | G1 | B1 |
| 2 | R2 | G2 | B2 |
| ⋮ | ⋮ | ⋮ | ⋮ |
| 255 | R255 | G255 | B255 |

FIG. 16

321

| IN | | OUT | | |
|---|---|---|---|---|
| | | R | G | B |
| 0 | CREG1 | R_CL1 | G_CL1 | B_CB1 |
| | CREG2 | R_CL2 | G_CL2 | B_CB2 |
| | ⋮ | ⋮ | ⋮ | ⋮ |
| | CREGn | R_CLn | G_CLn | B_CBn |
| 1 | | R1 | G1 | B1 |
| 2 | | R2 | G2 | B2 |
| ⋮ | | ⋮ | ⋮ | ⋮ |
| 255 | | R255 | G255 | B255 |

FIG. 17

| | | | | |
|---|---|---|---|---|
| CREG1 | IREG1 | CREG2 | IREG2 | CREG3 |
| IREG3 | IREG4 | IREG5 | IREG6 | IREG7 |
| CREG4 | IREG8 | CREG5 | IREG9 | CREG6 |
| IREG10 | IREG11 | IREG12 | IREG13 | IREG14 |
| CREG7 | IREG15 | CREG8 | IREG16 | CREG9 |

ADAPTIVE BLACK CLIPPING CIRCUIT, DISPLAY DEVICE INCLUDING THE SAME AND ADAPTIVE BLACK CLIPPING METHOD

CROSS REFERENCE TO RELATED APPLICATION

This application claims priority from and the benefit of Korean Patent Application No. 10-2014-0145408 filed on Oct. 24, 2014, which is incorporated by reference for all purposes as if fully set forth herein.

BACKGROUND

Field

Exemplary embodiments relate to a display device. More particularly, exemplary embodiments relate to an adaptive black clipping circuit for enhancing display quality, a display device including the adaptive black clipping circuit, and an adaptive black clipping method.

Discussion of the Background

A liquid crystal display (LCD) device that uses a thin film transistor (TFT) as a switching element is widely used. The LCD device includes a first substrate including pixel or pixel units each having a respective, to-be-charged pixel electrode, a second substrate including a common electrode, and a liquid crystal layer disposed between the first and second substrates. If an electric field having a same direction or polarity is continuously applied to the liquid crystal layer, a desired characteristic of a liquid crystal may be degraded. In order to prevent the degradation of the characteristic of the liquid crystal, an inversion driving method may be used which repeatedly inverts a polarity of a data voltage applied across the liquid crystal by unit of frame, by unit of row or by unit of pixel, where the polarity is with respect to a common voltage applied to the common electrode.

For example, in case of a dot inversion method (DIM) in which the polarity of the data voltage is inverted repeatedly by unit of pixel (that is, pixel by pixel), the degradation of the characteristic of the liquid crystal may be prevented or reduced. However, the process of providing the inverted or not inverted data voltages to respective individual pixels may be complicated, signals on the data lines may be delayed as a result, and power consumption of the LCD device may be disadvantageously increased. To solve the above-mentioned problems, a column inversion method has been proposed in which the data voltages having polarities different from each other are applied to adjacent data lines. When employing the column inversion method, the polarity of data voltage applied to each respective data line is inverted in each successive frame so that the applying process of the data voltage may be simplified, and the delay time of the signals on the data lines may be decreased.

To obtain the DIM checkerboard effect while instead using the column inversion method, pixels in a single column are alternately connected to one of two data lines adjacent to the column of pixels. In addition, a precharge driving method may be used to compensate for a charging time that tends to become shortened according to increase of resolution. However, when the precharge driving method is used, the appropriate precharging voltage is sufficiently charged only onto some pixel electrodes but not onto other pixel electrodes (where precharging is based on a previous data voltage applied to nearby pixel electrodes), and a difference of effective precharging relative to desired luminance can develop as between two adjacent rows of pixels.

Accordingly, a difference of actual luminance between two adjacent rows of pixels (as opposed to desired luminances) may be undesirably created due to the difference of effective or ineffective prechargings applied to those adjacent rows. Thus, a horizontal dark or bright streak line may appear to be displayed on a display panel as an undesirable artifact resulting from the precharging process so that displayed image appears to have defects.

The above information disclosed in this Background section is only for enhancement of understanding of the background of the inventive concept, and, therefore, it may contain information that does not form the prior art that is already known in this country to a person of ordinary skill in the art.

SUMMARY

An exemplary embodiment provides an adaptive black clipping circuit capable of efficiently compensating for a difference of charging ratio between pixels by detecting a predetermined pattern.

An exemplary embodiment also provides a display device including an adaptive black clipping circuit capable of efficiently compensating for a difference of charging ratio between pixels by detecting a predetermined pattern.

An exemplary embodiment also provides an adaptive black clipping method capable of efficiently compensating for a difference of charging ratio between pixels by detecting a predetermined pattern.

Additional aspects will be set forth in the detailed description which follows, and, in part, will be apparent from the disclosure, or may be learned by practice of the inventive concept.

An exemplary embodiment discloses an adaptive black clipping circuit in a display device that includes a data corrector configured to correct input image data to generate corrected image data such that the corrected image data is greater than or equal to a black clipping value, the black clipping value is greater than zero and corresponds to the input image data having a grayscale value of zero, a register configured to store and provide configuration data, a pattern detector configured to generate a pattern detection signal based on the input image data corresponding to a plurality of pixel rows, and a clipping selector configured to select one of the corrected image data and the configuration data in response to the pattern detection signal to provide output image data.

An exemplary embodiment also discloses a display device that includes a display panel including a plurality of pixels coupled to a plurality of data lines and a plurality of gate lines, an adaptive black clipping circuit configure to provide output image data based on input image data, a data driver configured to output data voltages corresponding to the output image data to the plurality of data lines, and a gate driver configured to output gate driving signals to the plurality of gate lines. The adaptive black clipping circuit includes a data corrector configured to correct the input image data to generate corrected image data such that the corrected image data is greater than or equal to a black clipping value, the black clipping value is greater than zero and corresponds to the input image data having a grayscale value of zero, a register configured to store and provide configuration data, a pattern detector configured to generate a pattern detection signal based on the input image data corresponding to a plurality of pixel rows, and a clipping selector configured to select one of the corrected image data and the configuration data in response to the pattern detection signal to provide the output image data.

An exemplary embodiment further discloses a black clipping method in a display device including correcting input image data to generate corrected image data such that the corrected image data is greater than or equal to a black clipping value, the black clipping value is greater than zero and corresponds to the input image data having a grayscale value of zero, storing and providing configuration data, generating a pattern detection signal based on the input image data corresponding to a plurality of pixel rows, and selecting one of the corrected image data and the configuration data in response to the pattern detection signal to provide output image data.

The foregoing general description and the following detailed description are exemplary and explanatory and are intended to provide further explanation of the claimed subject matter.

BRIEF DESCRIPTION OF THE DRAWINGS

The accompanying drawings, which are included to provide a further understanding of the inventive concept, and are incorporated in and constitute a part of this specification, illustrate exemplary embodiments of the inventive concept, and, together with the description, serve to explain principles of the inventive concept.

FIG. 16 is a diagram illustrating an example of a lookup table included in the data corrector of FIG. 15.

FIG. 17 is a diagram for describing an interpolating method with a plurality of clipping regions.

DESCRIPTION OF THE ILLUSTRATED EMBODIMENTS

Figure 1:
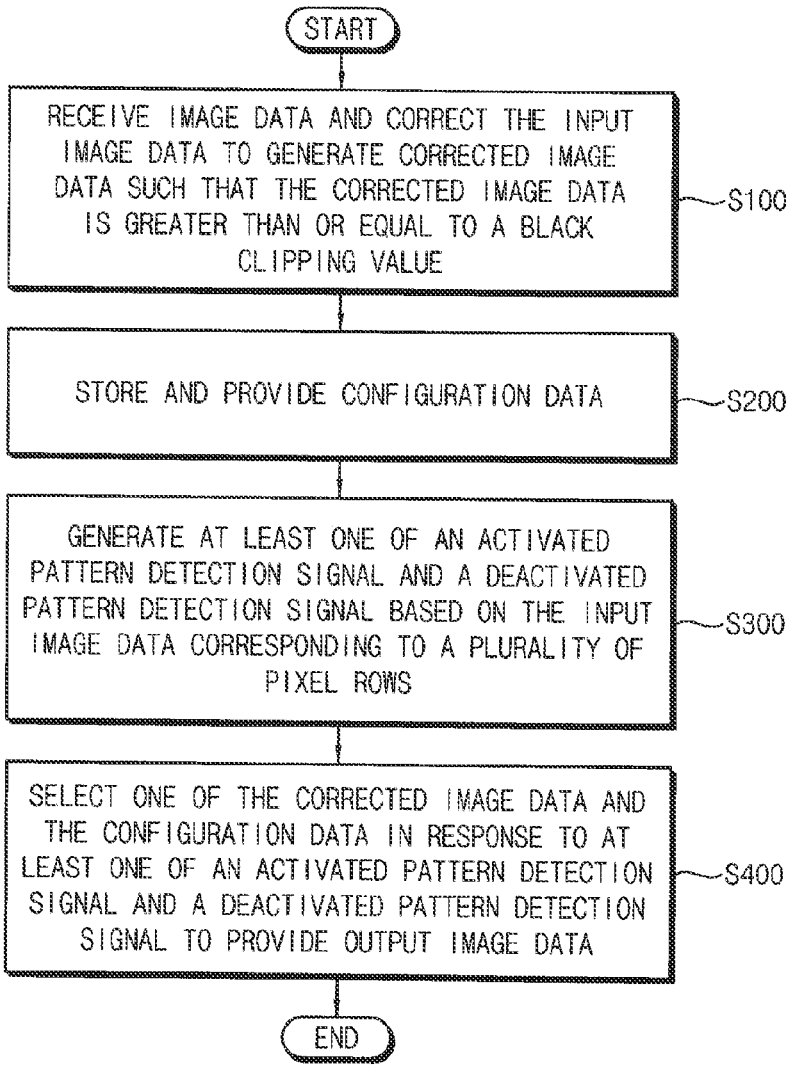
FIG. 1 is a flow chart illustrating an adaptive black clipping method according to an exemplary embodiment.

In the following description, for the purposes of explanation, numerous specific details are set forth in order to provide a thorough understanding of various exemplary embodiments. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments.

In the accompanying figures, the size and relative sizes of layers, films, panels, regions, etc., may be exaggerated for clarity and descriptive purposes. Also, like reference numerals denote like elements.

When an element or layer is referred to as being "on," "connected to," or "coupled to" another element or layer, it may be directly on, connected to, or coupled to the other element or layer or intervening elements or layers may be present. When, however, an element or layer is referred to as being "directly on," "directly connected to," or "directly coupled to" another element or layer, there are no intervening elements or layers present. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. Like numbers refer to like elements throughout. As used herein, the term "and/or" includes any and all combinations of one or more of the associated listed items.

Although the terms "first," "second," etc. may be used herein to describe various elements, components, regions, layers, and/or sections, these elements, components, regions, layers, and/or sections should not be limited by these terms. These terms are used to distinguish one element, component, region, layer, and/or section from another element, component, region, layer, and/or section. Thus, a first element, component, region, layer, and/or section discussed below could be termed a second element, component, region, layer, and/or section without departing from the teachings of the present disclosure.

Spatially relative terms, such as "beneath," "below," "lower," "above," "upper," and the like, may be used herein for descriptive purposes, and, thereby, to describe one element or feature's relationship to another element(s) or feature(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and will not be interpreted in an idealized or overly formal sense, unless expressly so defined herein.

FIG. 1 is a flow chart illustrating an adaptive black clipping method according to an exemplary embodiment.

Referring to FIG. 1, a display device includes a timing controller and an adaptive black clipping circuit. The adaptive black clipping circuit receives input image data and corrects the input image data to generate corrected image data such that the corrected image data is greater than or equal to a black clipping value (S100). The black clipping value is greater than zero and corresponds to the input image data having a grayscale value of zero. The black clipping is to intentionally distort the data voltage corresponding to the grayscale value of zero to compensate for the difference of precharging between pixels. The adaptive black clipping circuit may perform black clipping by setting the black clipping value to a value greater than zero when the input data equals a grayscale value of zero. Thus, the corrected image data (which is greater than or equal to the black clipping value) is also affected, thereby correcting the black data.

Figures 5, 6:
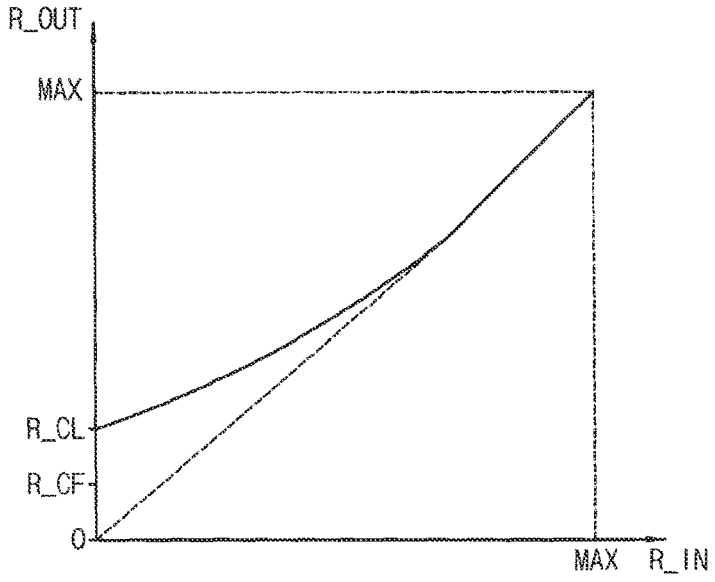
FIG. 5 is a diagram illustrating an example of a lookup table included in the data corrector of FIG. 4.
FIG. 6 is a diagram illustrating an example of black clipping and data correction by the data corrector of FIG. 4.

An adaptive black clipping circuit stores and provides configuration data (S200). The configuration data may be for an areal black pattern. The areal black pattern may indicate an assembly of pixels that are adjacent to each other and have the black data. In an exemplary embodiment, the areal black pattern may be defined as pixels of at least two adjacent rows having the black data. In another exemplary embodiment, the areal black pattern may be defined as pixels of at least three adjacent rows having the black data. The configuration data may be set to a proper value depending on a configuration of a display device, operational conditions, etc. In an exemplary embodiment, the configuration data may be set to a non-zero value smaller than the black clipping value as illustrated in FIG. 6. In another exemplary embodiment, the configuration data may be set to a value of zero.

An adaptive black clipping circuit generates at least one of an activated pattern detection signal and a deactivated pattern detection signal based on the input image data corresponding to a plurality of pixel rows (S300). The pattern detection signal may be activated when the input image data corresponds to the areal black pattern. The exemplary embodiment of generating the pattern detection signal based the input image data of the plurality of pixel rows will be described with reference to FIG. 7.

The adaptive black clipping circuit selects one of the corrected image data and the configuration data in response to at least one of an activated pattern detection signal and a deactivated pattern detection signal to provide output image data (S400). When the input image data has the grayscale value of zero and the pattern detection signal is deactivated, the black clipping is performed and the corrected image data corresponding to the black clipping value may be provided as the output image data. When the input image data has the grayscale value of zero and the pattern detection signal is activated, the black clipping is not performed and the configuration data instead of the corrected image data may be provided as the output image data.

As such, the adaptive black clipping method according to exemplary embodiments may improve display defects of a horizontal stripe and prevent reduction of contrast ratio by detecting the areal black pattern based on the input image corresponding to a plurality of pixel rows. In addition, the adaptive black clipping method may improve display defects of a vertical stripe that may be caused when data voltages are output sequentially to data lines to reduce electromagnetic interferences between the data lines.

Figure 2:
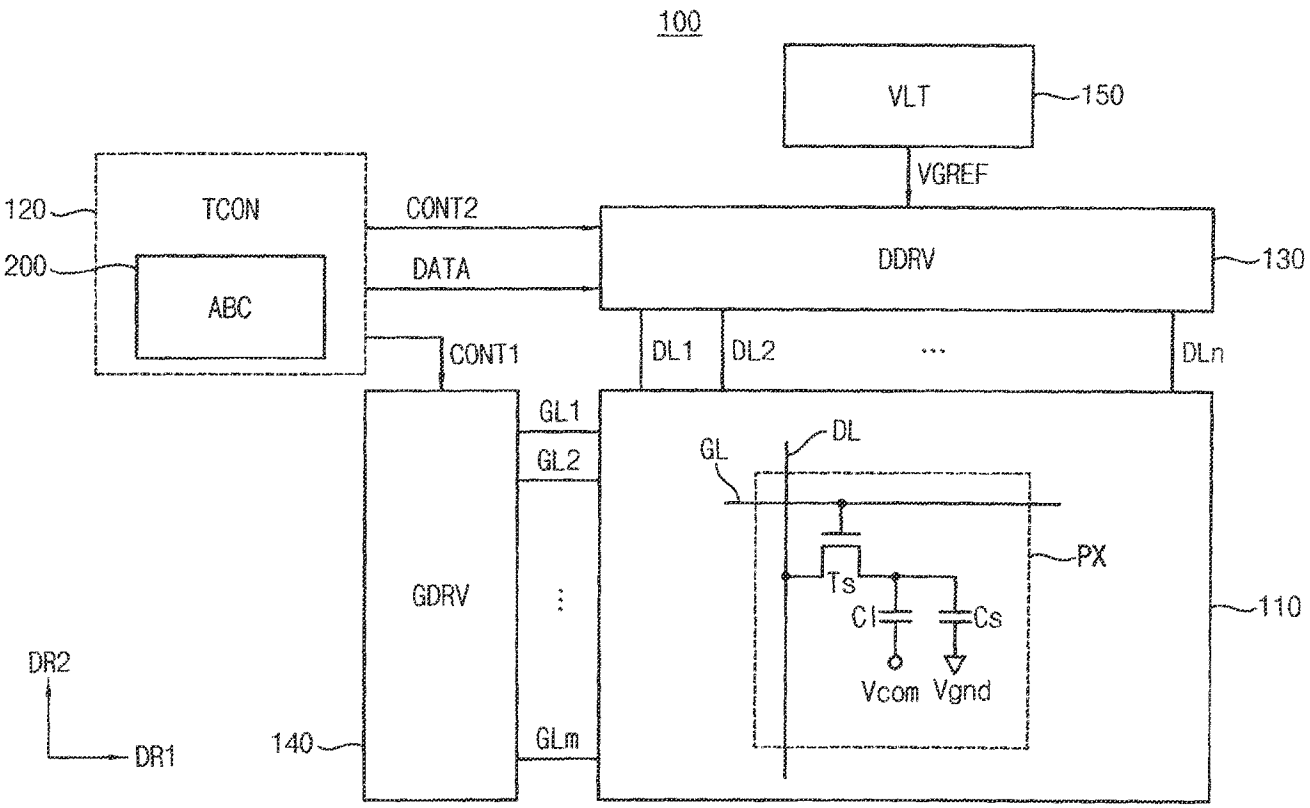
FIG. 2 is a block diagram illustrating a display device according to an exemplary embodiment.

FIG. 2 is a block diagram illustrating a display device according to an exemplary embodiment.

Referring to FIG. 2, a display device 100 includes a display panel 110, a timing controller (TCON) 120, a data driver (DDRV) 130, a gate driver (GDRV) 140, a gamma voltage generator (VLT) 150, and an adaptive black clipping circuit (ABC) 200. Although not illustrated in FIG. 2, the display device 100 may further include other components such as a buffer for storing image data to be displayed and a back light unit.

The display panel 110 includes a plurality of pixels PX coupled to a plurality of data lines DL1 to DLn and a plurality of gate lines GL1 to GLm, respectively. As illustrated in FIG. 2, each pixel PX may include a switching element Ts, a liquid crystal capacitor Cl, and a storage capacitor Cs. The switching element Ts connects the capacitors Cl and Cs to a corresponding data line in response to a gate driving signal transferred through the corresponding gate line. The liquid crystal capacitor Cl is connected between the switching element Ts and the common voltage Vcom. The storage capacitor Cs is connected between the switching element Ts and the ground voltage Vgnd.

In an exemplary embodiment, the pixels PX may be arranged in a matrix comprising m rows and n columns. The pixels PX in the display panel 110 are connected to the data driver 130 through the data lines DL1 to DLn and to the gate driver 140 through the gate lines GL1 to GLm.

The data driver 130 provides data signals to display panel 110 by providing data voltages to the data lines DL1 to DLn. The gate driver 140 provides gate driving signals through the gate lines GL1 to GLm for controlling rows of pixels PX. The timing controller 120 controls overall operations of the display device 100. The timing controller 120 may provide control signals CONT1 and CONT2 to control gate driver 140 and the data driver 130, respectively to control the display panel 110. In an exemplary embodiment, the timing controller 120, the data driver 130, and the gate driver 140 are implemented as a single integrated circuit (IC). In an exemplary embodiment, the timing controller 120, the data driver 130, and the gate driver 140 are implemented as two or more ICs.

The gamma voltage generator 150 generates gamma voltages VGREF and provides the gamma voltages VGREF to the data driver 130. The gamma voltages VGREF have voltage levels corresponding to the display data DATA. For example, the gamma voltage generator 150 may include a resistor string circuit such that a plurality of resistors are coupled in series between a power supply voltage and a ground voltage to provide divided voltages as the gamma voltages VGREF. In an exemplary embodiment, the gamma voltage generator 150 may be included in the data driver 130.

The display device 100 includes the adaptive black clipping circuit 200 according to according to an exemplary embodiment. The adaptive black clipping circuit 200 detects the areal black pattern based on the input image data corresponding to a plurality of pixel rows and selectively performs the black clipping depending on the detected areal black pattern. Accordingly, a horizontal stripe defect of the display may be improved, reduction of contrast ratio due to the black clipping may be prevented, and a vertical stripe defect of the display caused when data voltages are output sequentially to data lines to reduce electromagnetic interferences between the data lines may be improved.

Figure 3:
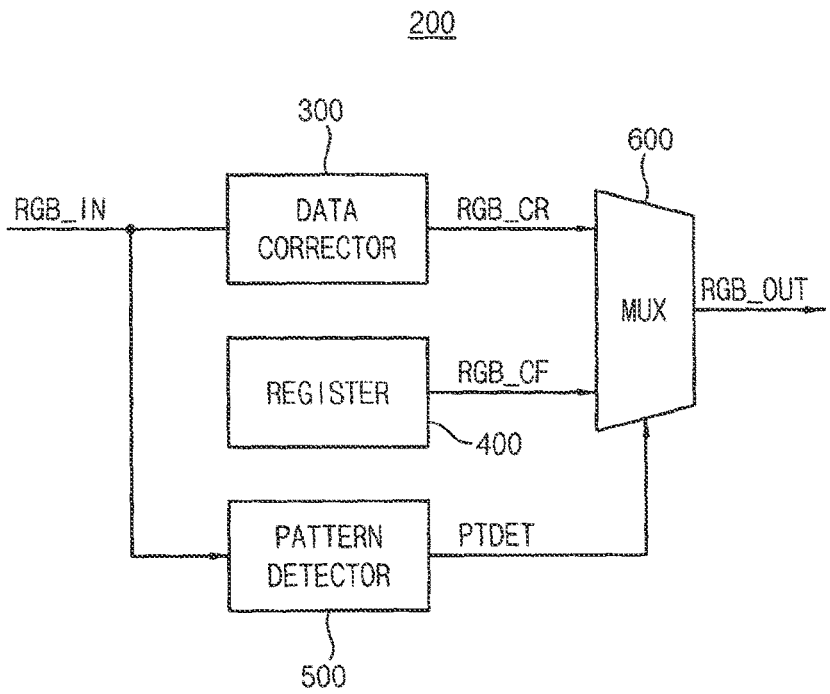
FIG. 3 is a block diagram illustrating an adaptive black clipping circuit according to an exemplary embodiment.

FIG. 3 is a block diagram illustrating an adaptive black clipping circuit according to an exemplary embodiment.

Referring to FIG. 3, an adaptive black clipping circuit 200 includes a data corrector 300, a register 400, a pattern detector 500, and a clipping selector 600.

Figure 7:
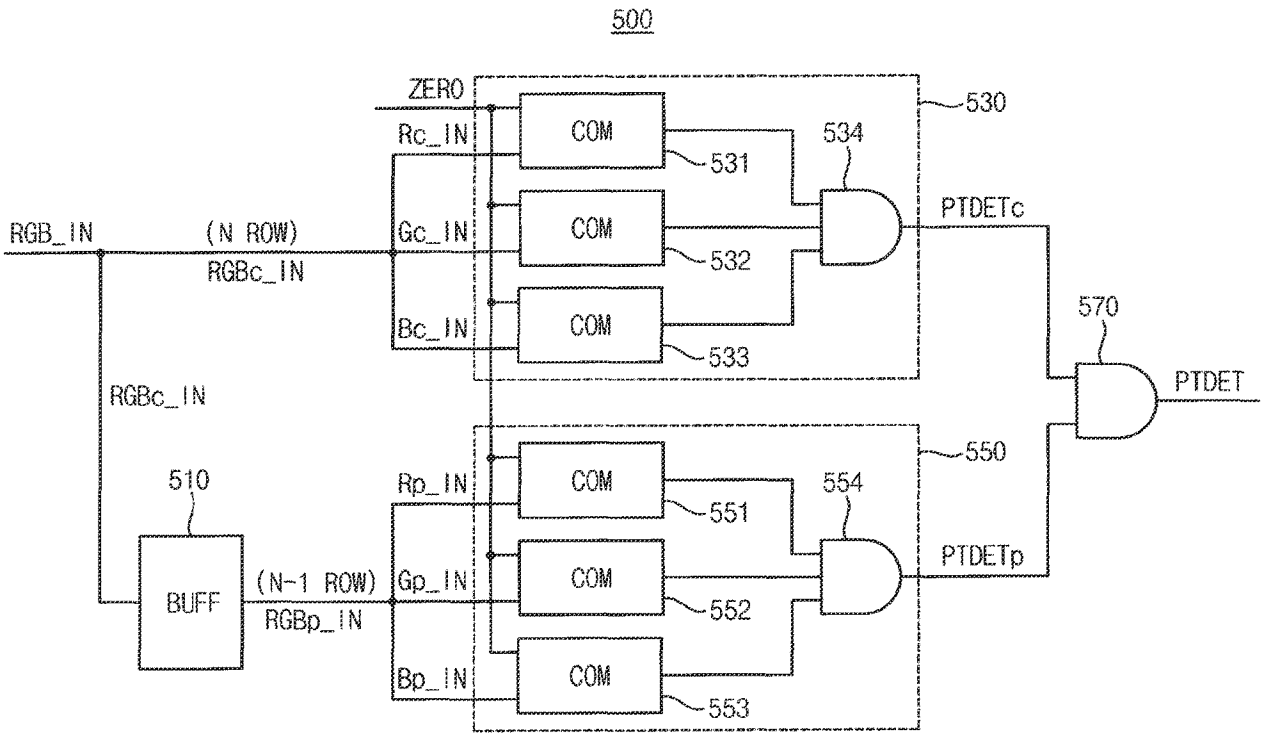
FIG. 7 is a diagram illustrating an example of a pattern detector included in the adaptive black clipping circuit of FIG. 3.

The data corrector 300 may correct input image data RGB_IN to generate corrected image data RGB_CR such that the corrected image data RGB_CR is greater than or equal to a black clipping value RGB_CL (not shown). As illustrated in FIG. 7, the input image data RGB_IN may include red input image data R_IN (shown as Rc_IN), green input image data G_IN (shown as Gc_IN), and blue input image data B_IN (shown as Bc_IN). Accordingly, the black clipping value RGB_CL may include a red black clipping value R_CL, a green black clipping value G_CL, and a blue black clipping value B_CL (not shown), and the corrected image data RGB_CR may include red corrected image data R_CR, green corrected image data G_CR, and blue corrected image data B_CR.

The black clipping value RGB_CL corresponds to the input image data having a grayscale value of zero and the black clipping value RGB_CL is set to a value greater than zero. The black clipping may be defined as intentionally distorting the data voltage corresponding to the grayscale value of zero to compensate for the difference of discharging between pixels. The data corrector 300 may perform the black clipping by setting the black clipping value RGB_CL to a value greater than zero when the input image data RGB_IN has a grayscale value of zero. Because the corrected image data RGB_CR is greater than or equal to the black clipping value RGB_CL set to a value greater than zero, the RGB_CR is set to a value greater than zero thereby correcting the black data.

The register 400 may store and provide configuration data RGB_CF for an areal data. The configuration data RGB_CF may include red configuration data R_CF, green configuration data G_CF, and blue configuration data B_CF (not shown). The areal black pattern may indicate an assembly of pixels that are adjacent to each other and have the black data. In an exemplary embodiment, the areal black pattern may be defined as a case in which the pixels of at least two adjacent rows have the black data. In another exemplary embodiment, the areal black pattern may be defined as a case in which the pixels of at least three adjacent rows have the black data. The configuration data RGB_CF may be set to a proper value depending on a configuration of a display device, operational conditions, etc. In an exemplary embodiment, the configuration data RGB_CF may be set to a non-zero value smaller than the black clipping value as illustrated in FIG. 6. In another exemplary embodiment, the configuration data RGB_CF may be set to a value of zero. When the configuration data RGB_CF is set to zero, the register 400 may be omitted and the input image data having the grayscale value of zero may be provided as the configuration data RGB_CF directly to the clipping selector 600.

The pattern detector 500 may generate a pattern detection signal PTDET based on the input image data RGB_IN corresponding to a plurality of pixel rows. The pattern detection signal PTDET may be activated when the input image data corresponds to the areal black data. In an exemplary embodiment, as described with reference to FIG. 7, the pattern detector 500 may activate the pattern detection signal PTDET when all of the grayscale values of the red input image data R_IN, the green input image data G_IN, and the blue input image data B_IN are zero with respect to the current pixel row ($N^{th}$ row) and the previous pixel row ($N-1^{th}$ row) adjacent to the current pixel row ($N^{th}$ row).

The clipping selector 600 may select one of the corrected image data RGB_CR and the configuration data RGB_CF in response to the pattern detection signal PTDET to provide output image data RGB_OUT. When the input image data RGB_IN has the grayscale value of zero and the pattern detection signal PTDET is deactivated, the black clipping is performed and the corrected image data RGB_CR corresponding to the black clipping value RGB_CL may be provided as the output image data RGB_OUT. When the input image data RGB_IN has the grayscale value of zero and the pattern detection signal PTDET is activated, the black clipping is not performed and the configuration data RGB_CF instead of the corrected image data RGB_CR may be provided as the output image data RGB_OUT.

Figure 4:
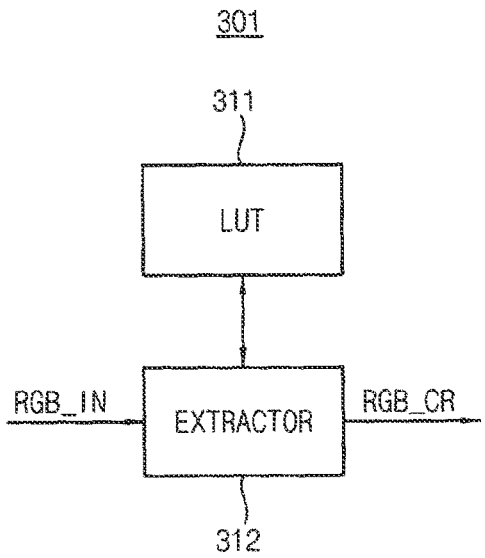
FIG. 4 is a block diagram illustrating an example of a data corrector included in the adaptive black clipping circuit of FIG. 3.

FIG. 4 is a block diagram illustrating an example of a data corrector included in the adaptive black clipping circuit of FIG. 3. FIG. 5 is a diagram illustrating an example of a lookup table included in the data corrector of FIG. 4.

Referring to FIG. 4, a data corrector 301 may include a lookup table (LUT) 311 and an extractor 312. The lookup table 311 may store corrected grayscale values respectively corresponding to grayscale values. The extractor 312 may extract the corrected grayscale value corresponding to the grayscale value of the input image data RGB_IN from the lookup table 311 to output the corrected image data RGB_CR.

FIG. 5 illustrates the corrected grayscale values OUT corresponding to the grayscale values IN from 0 to 255 when using 8-bit data. The corrected grayscale values OUT may include red corrected grayscale values R_CL and R1 to R255, green corrected grayscale values G_CL and G1 to G255, and blue corrected grayscale values B_CL and B1 to B255. Each of the corrected grayscale values OUT may be common regardless of the particular positions of the corrected grayscale values on the display panel 110 of the display device 100. In contrast, as will be described with reference to FIGS. 16 and 17, the black clipping values R_CL, G_CL and B_CL may be varied depending on the position on the display panel 110.

As illustrated in FIG. 5, the black clipping value RGB_CF may be the corrected grayscale value OUT corresponding to the grayscale value of zero and may include a red black clipping value R_CL corresponding to the grayscale value of zero of red input image data R_IN, a green black clipping value G_CL corresponding to the grayscale value of zero of green input image data G_IN, and a blue black clipping value B_CL corresponding to the grayscale value of zero of blue input image data B_CL. The red black clipping value R_CL, the green black clipping value G_CL, and the blue black clipping value B_CL may be set to the same value or different values depending on operational characteristics of the color pixels.

FIG. 6 is a diagram illustrating an example of black clipping and data correction by the data corrector of FIG. 4.

FIG. 6 illustrates exemplary mapping relations between the red input image data R_IN and the red output image data R_OUT. The green and blue data may have mapping relations similar to that of FIG. 6. Thus, the repeated illustration and description are omitted for brevity.

As illustrated in FIG. 6, to compensate for the discharging difference between the pixels, the red black clipping value R_CL may be set to a value greater than the black data or zero. For example, the red black clipping value R_CL may be set to a value between 0.75 and 2 when using 8-bit image data. In a display panel having a zigzag pattern as described with reference to FIG. 8, the display panel may display horizontal strips as defects. However, horizontal stripe defects may be improved by changing the black voltage slightly from the common voltage. In other words, the black voltage corresponding to the grayscale of zero may be increased from the minimum data voltage (e.g., 0V) in case of the positive driving (+) or may be decreased from the maximum data voltage in case of the negative driving (−). Even though the lower grayscale values including the black level are corrected as illustrated in FIG. 6, the luminance change recognized by the human eyes is negligible but the display defects due to the precharging difference between pixels may be improved significantly.

FIG. 7 is a diagram illustrating an example of a pattern detector included in the adaptive black clipping circuit of FIG. 3.

Referring to FIG. 7, a data pattern detector 500 may include a buffer 510, a first detector 530, a second detector 550, and a logic gate 570.

The first detector 530 may receive first input image data RGBc_IN of a current pixel row (e.g., the $N^{th}$ row) to generate a first detection signal PTDETc that is activated when the first input image data RGBc_IN is black data. The first input image data RGBc_IN may include first red input image data Rc_IN, first green input image data Gc_IN, and first blue input image data Bc_IN.

The buffer 510 may receive the first input image data RGBc_IN and output second input image data RGBp_IN of a previous pixel row (e.g., $N-1^{th}$ row) adjacent to the current pixel row. In other words, the buffer 510 may convert the first input image data RGBc_IN to second input image data RGBp_IN.

The second detector 550 may receive the second input image data RGBp_IN to generate a second detection signal PTDETp that is activated when the second input image data RGBp_IN is black data. The second input image data RGBp_IN may include second red input image data Rp_IN, second green input image data Gp_IN, and second blue input image data Bp_IN.

The logic gate 570 may perform a logic operation on the first detection signal PTDETc and the second detection signal PTDETp to generate the pattern detection signal PTDET that is activated when both of the first detection signal PTDETc and the second detection signal PTDETp are activated. When the first detection signal PTDETc and the second detection signal PTDETp are high active signals, the logic gate 570 may be implemented with an AND logic gate.

The first detector 530 may include a first comparator (COM) 531, a second comparator 532, a third comparator 533, and a first AND logic gate 534. The first comparator 531 may generate a first comparison signal that is activated to a logic high level when first red input image data Rc_IN of the current pixel row has a grayscale of zero. The second comparator 532 may generate a second comparison signal that is activated to the logic high level when first green input image data Gc_IN of the current pixel row has the grayscale of zero. The third comparator 533 may generate a third comparison signal that is activated to the logic high level when first blue input image data Bc_IN of the current pixel row has the grayscale of zero. The first AND logic gate 534 may perform an AND logic operation on the first comparison signal, the second comparison signal, and the third comparison signal to generate the first detection signal PTDETc.

The second detector 550 may include a fourth comparator 551, a fifth comparator 552, a sixth comparator 553, and a second AND logic gate 554. The fourth comparator 551 may generate a fourth comparison signal that is activated to the logic high level when the second red input image data Rp_IN of the previous pixel row has the grayscale of zero. The fifth comparator 552 may generate a fifth comparison signal that is activated to the logic high level when second green input image data Gp_IN of the previous pixel row has the grayscale of zero. The sixth comparator 553 may generate a sixth comparison signal 553 that is activated to the logic high level when second blue input image data Bp_IN of the previous pixel row has the grayscale of zero. The second AND logic gate 554 may perform an AND logic operation on the fourth comparison signal, the fifth comparison signal, and the sixth comparison signal to generate the second detection signal PTDETp.

As a result, the pattern detector 500 of FIG. 7 may detect the areal black pattern and activate the pattern detection signal PTDET when grayscale values of the red input image data, the green input image data, and the blue input image data are zero with respect to the two consecutive pixel rows (e.g., N−1th row and Nth row). FIG. 7 illustrates the non-limiting exemplary embodiment that the areal black pattern is determined based on the input image data corresponding to two consecutive pixel rows, but the areal black pattern may be determined based on the input image data corresponding to three or more consecutive pixel rows.

Figure 8:
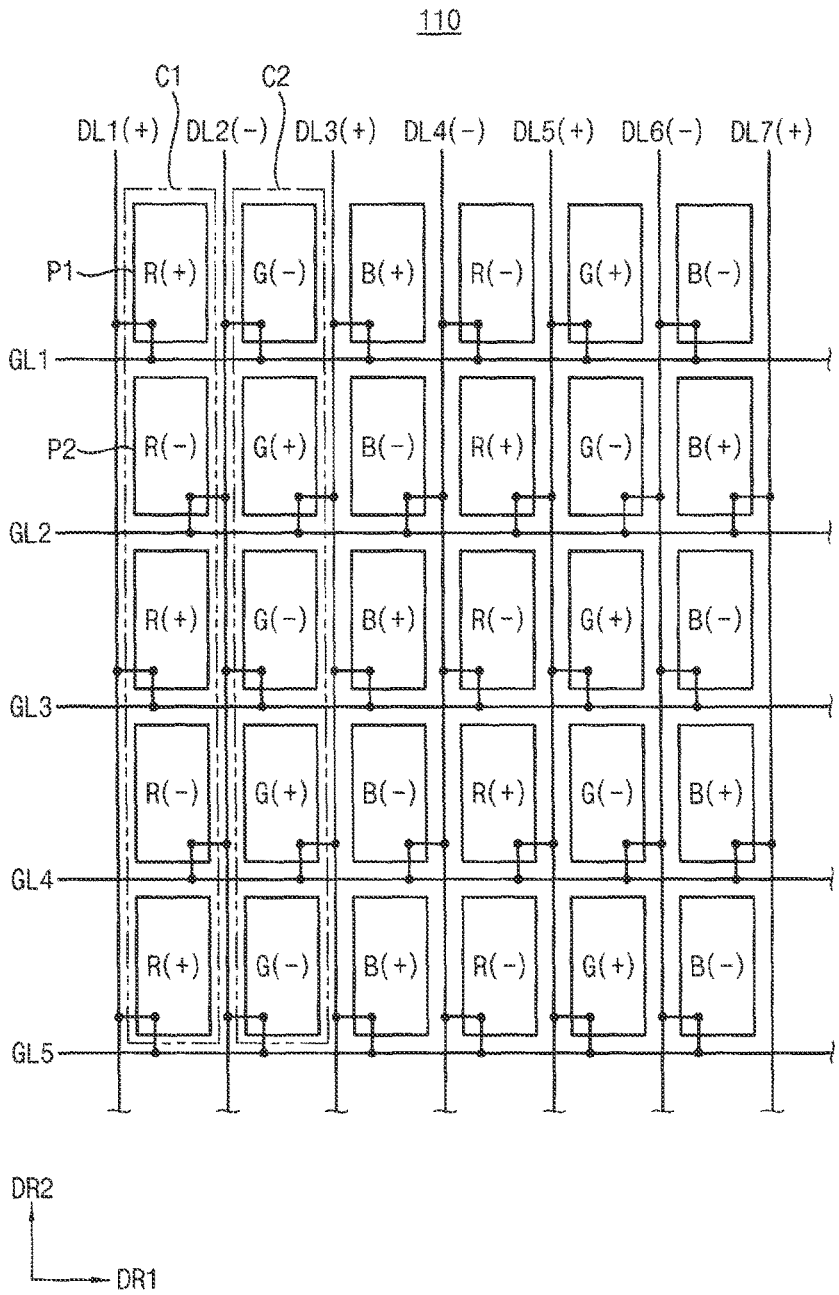
FIG. 8 is a diagram illustrating an example of a pixel structure of a display panel included in the display device of FIG. 2.

FIG. 8 is a diagram illustrating an example of a pixel structure of a display panel 110 included in the display device of FIG. 2.

Referring to FIGS. 2 and 8, the display panel 110 may include a plurality of pixels coupled to a plurality of gate lines GL1 to GLm and a plurality of data lines DL1 to DLn, respectively. The pixels may be divided into the red pixels R, the green pixels G, and the blue pixels B. The gate lines GL1 to GLm are extended in a first direction DR1 while the data lines DL1 to DLn are extended in a second direction DR2 crossing the first direction D1. The pixels define a plurality of pixel columns (e.g., C1, C2) arranged to extend in the second direction DR2. The pixels that are found when traveling longitudinally down each pixel column (i.e., in the DR2 direction) are alternately connected to two data lines adjacent to that pixel column.

For example, a first pixel column C1 is disposed between a first data line DL1 and a second data line DL2. A second pixel column C2 adjacent to the first pixel column C1 is disposed between the second data line DL2 and a third data line DL3. The successive pixels in the first pixel column C1 are alternately connected to the first and second data lines DL1 and DL2 while the successive pixels in the second pixel column C2 are alternately connected to the second and third data lines DL2 and DL3. Such pixel structure may be referred to as a zigzag pattern. Data voltages having opposite polarities are respectively applied to respective pairs of adjacent data lines. More specifically, when a luminance-defining first data voltage having a positive polarity (+) is applied to the first data line DL1, a luminance-defining second data voltage having a negative polarity (−) (i.e., inverted with respect to the common voltage and thus opposite of the positive polarity (+)) is applied to the second data line DL1. A data voltage having the positive polarity (+) is applied to the third data line DL3. Accordingly, the inverted data voltages having the polarities of +, −, +, −, +, . . . are respectively applied to the successive pixels found in the first pixel column C1, and the inverted data voltages having the polarities of −, +, −, +, −, . . . are respectively applied to the successive pixels found in the second pixel column C2. The first pixel column C1 includes a first pixel P1 connected to a first gate line GL1 and the first data line DL1. The first pixel column C1 also includes a second pixel P2 connected to a second gate line GL2 and the second data line DL2.

As a result, the display panel 110 may have a dot inversion effect. In other words, each pixel is inverted in the first direction DR1 and the second direction DR2 even though a column inversion method is being used.

In addition, in a next frame (as oppose to the first frame shown in FIG. 8), data voltages having the negative polarity (−) will be applied to the first data line DL1 while data voltage having the positive polarity (+) will be applied to the second data line DL2. Furthermore, data voltages having the negative polarity (−) will be applied to the third data line DL3. Accordingly, in the next frame, the inverted data voltages having the polarities of −, +, −, +, −, . . . are respectively applied to the pixels in the first pixel column C1, and the inverted data voltages having the polarities of +, −, +, −, +, . . . are respectively applied to the pixels in the second pixel column C2. Thus, the inverted data voltages in each frame are applied to each pixel P of the display panel 110.

Figure 9:
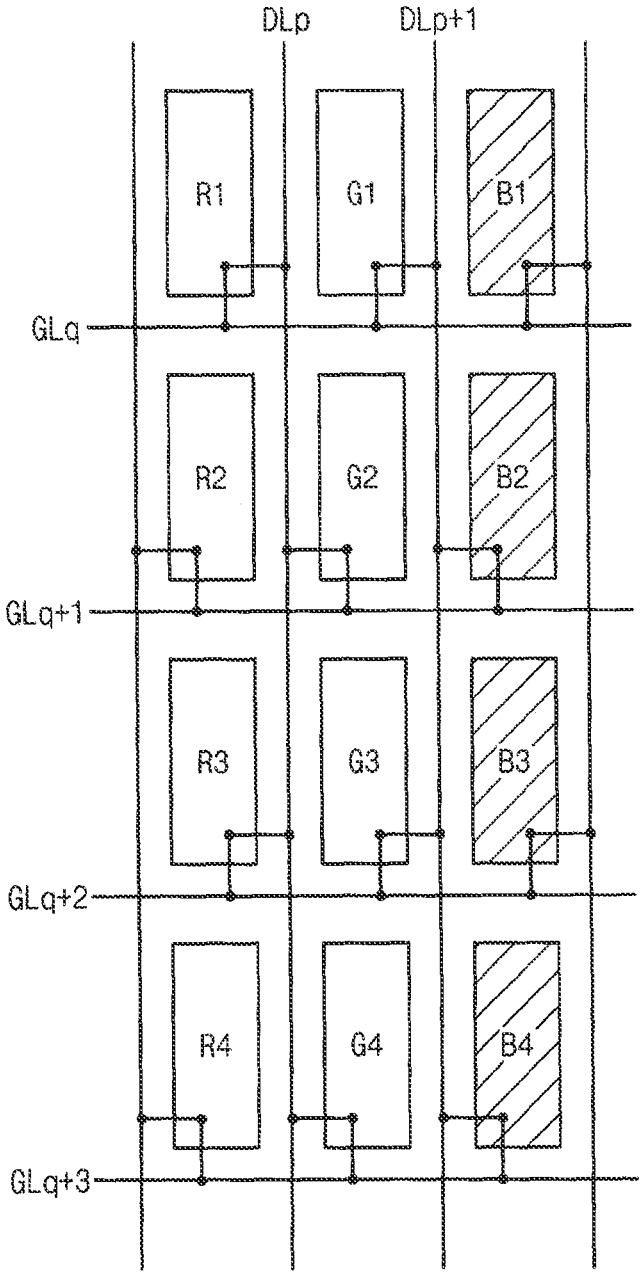
FIG. 9 is a diagram illustrating a portion of a display panel included in the display device of FIG. 2 for describing display defects that may be caused in a 3-line precharging method.
Figure 10:
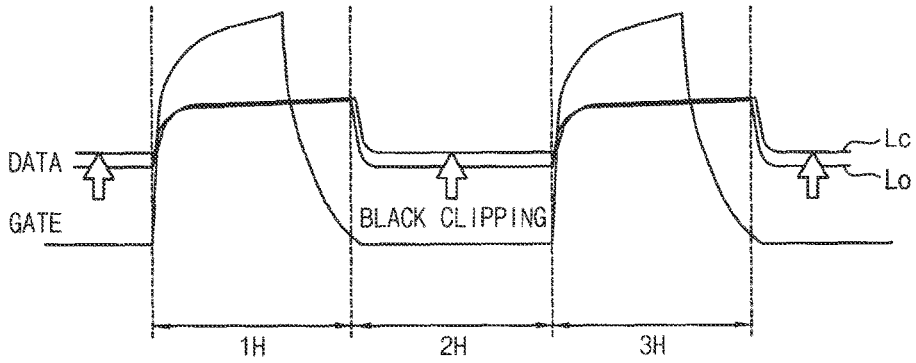
FIG. 10 is a diagram for describing compensation of a difference of charging ratio through black clipping in a 3-line precharging method.

FIG. 9 is a diagram illustrating a portion of a display panel 110 included in the display device of FIG. 2 for describing display defects that may be caused in a 3-line precharging method. FIG. 10 is a diagram for describing a difference of charging ratio through black clipping in a 3-line precharging method.

Referring to FIGS. 9 and 10, it is assumed that first, second, third, and fourth red pixels R1, R2, R3, and R4 and first, second, third, and fourth green pixels G1, G2, G3, and G4 correspond to high grayscale voltages. It is also assumed that first, second, third, and fourth blue pixels B1, B2, B3, and B4 correspond to low grayscale voltages. In other words, the first, second, third, and fourth red pixels R1, R2, R3, and R4 and the first, second, third, and fourth green pixels G1, G2, G3, and G4 may be driven with white voltage or the maximum grayscale voltage to represent the white color while the first, second, third, and fourth blue pixels B1, B2, B3, and B4 may be driven with black voltage or the common voltage to represent the black color.

For example, in case of the third green pixel G3, referring to FIG. 10, the high grayscale voltage of the first green pixel G1 is precharged to the third green pixel G3 during the first horizontal period 1H, the low grayscale voltage of the second blue pixel B2 is precharged to the third green pixel G3 during the second horizontal period 2H, and then the high grayscale voltage corresponding to the data voltage of the third green pixel G3 is charged finally to the third green pixel G3 during the third horizontal period 3H. In this case, the effect of precharging is weak because the low grayscale voltage is precharged during the second horizontal period 2H, and thus the third green pixel G3 displays the relatively dark green.

For example, in case of the fourth green pixel G4, referring to FIG. 10, the high grayscale voltage of the second green pixel G2 is precharged to the fourth green pixel G4 during the first horizontal period 1H, the high grayscale voltage of the third red pixel R3 is precharged to the fourth green pixel G4 during the second horizontal period 2H, and then the high grayscale voltage corresponding to the data voltage of the fourth green pixel G4 is charged finally to the fourth green pixel G4 during the third horizontal period 3H. In this case, the effect of precharging is strong because the high grayscale voltage is precharged during the second and third horizontal periods 2H and 3H, and thus the fourth green pixel G4 displays the relatively bright green.

Such difference of precharging results in causing the difference of charging ratio. As a result of the difference of charging ratio between the third and fourth green pixels G3 and G4, the horizontal stripe may be recognized to cause display defects. The charging ratio difference may be compensated by clipping the black level Lo to the black clipping level Lc as illustrated in FIG. 10, thereby improving the horizontal stripe display defect.

Figure 11:
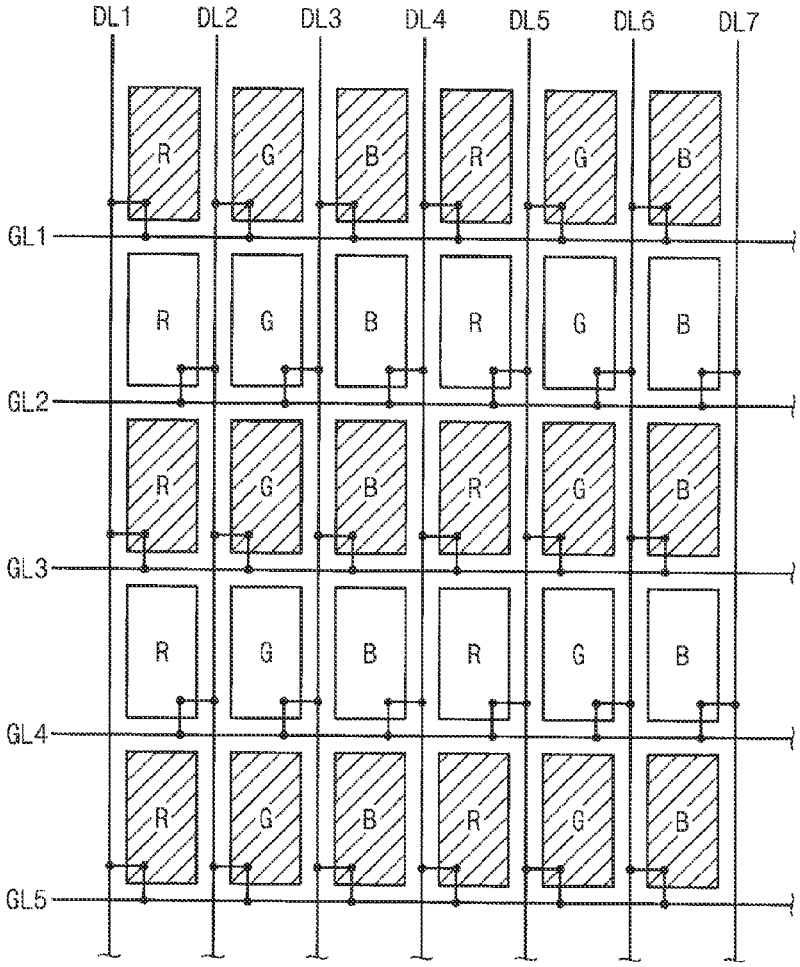
FIG. 11 is a diagram illustrating a portion of a display panel included in the display device of FIG. 2 for describing display defects that may be caused in selectively performing black clipping.

FIG. 11 is a diagram illustrating a portion of a display panel included in the display device of FIG. 2 for describing display defects that may be caused in selectively performing black clipping.

FIG. 11 illustrates an image pattern such that the black data (i.e., the data voltages corresponding to the minimum grayscale value of zero) is applied to the pixels coupled to the odd-numbered gate lines GL1, GL3, and GL5 and the data voltages corresponding to the maximum grayscale value are applied to the pixels coupled to the even-numbered gate lines GL2 and GL4. In case of the areal black pattern, the black data is not clipped to the black clipping value and the black data is bypassed or replaced with the above-described configuration data to prevent the reduction of contrast ratio recognized by human eyes. In case of the data pattern including the horizontal stripe of the black data as illustrated in FIG. 11, a vertical stripe display defect may be caused as described with reference to FIGS. 12 and 13.

Figure 12:
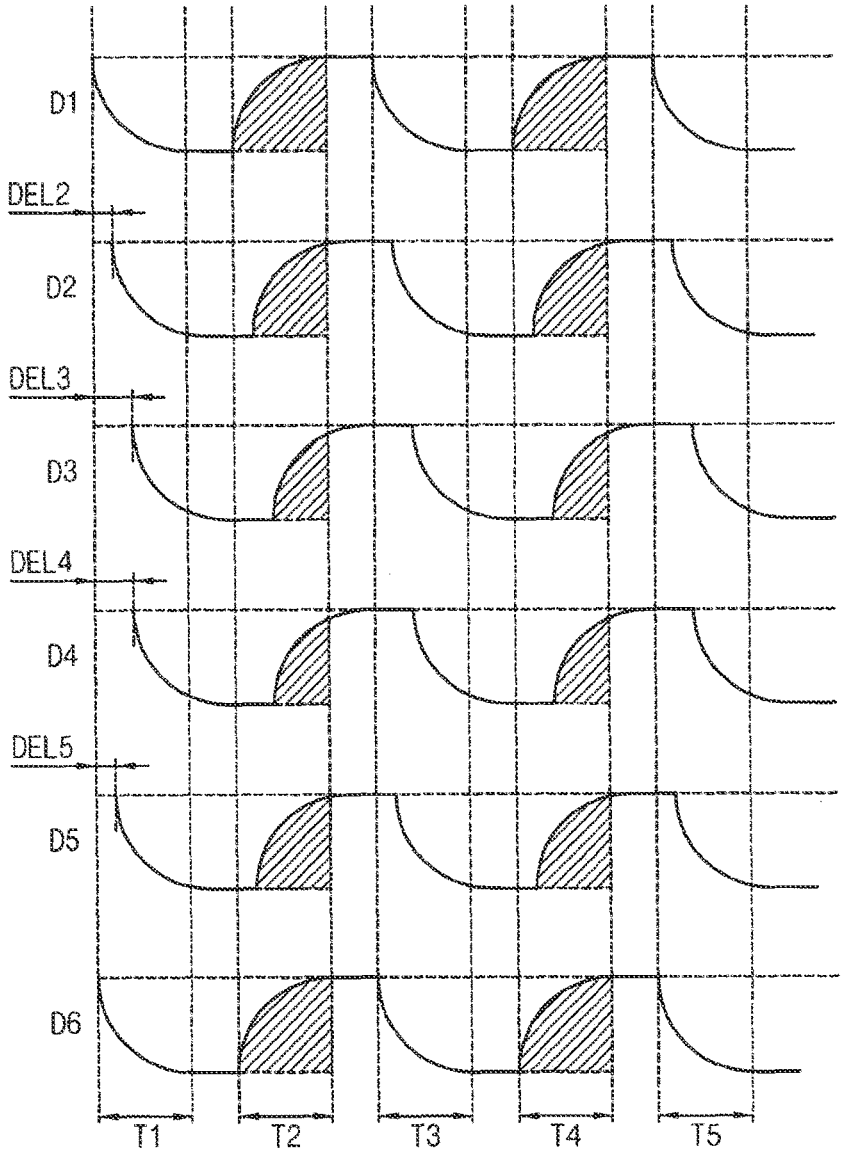
FIG. 12 is a diagram for describing a difference of charging ratio when data voltages are applied sequentially to reduce electromagnetic interferences.
Figure 13:
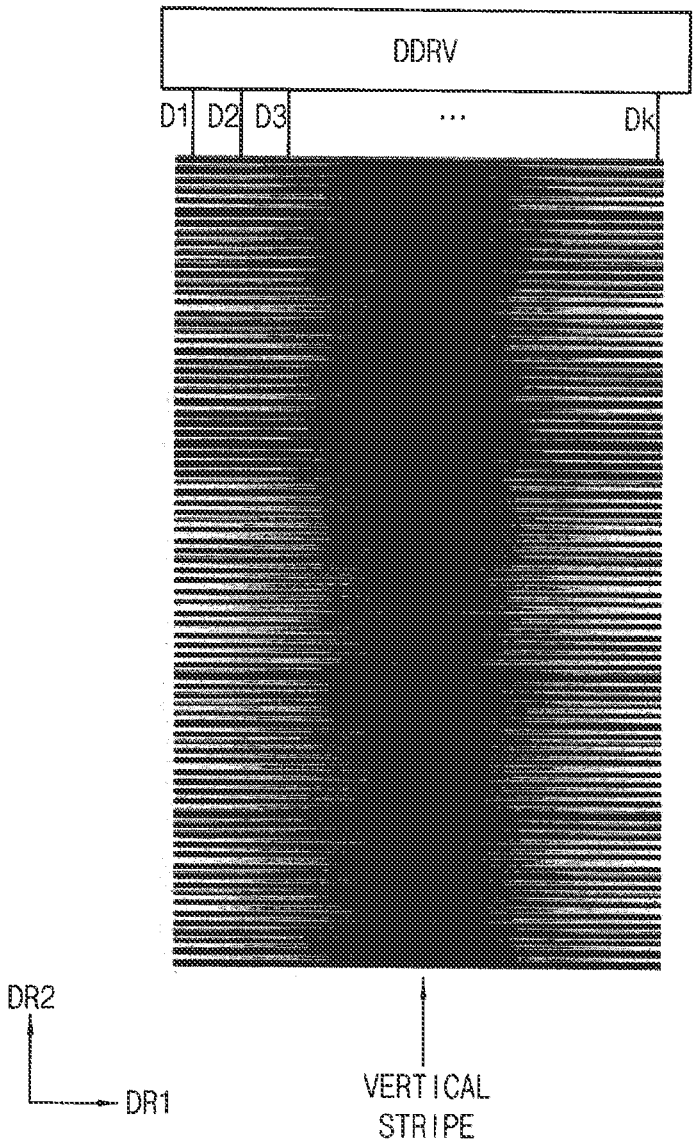
FIG. 13 is a diagram illustrating display defects of a vertical stripe due to the difference of charging ratio of FIG. 12.

FIG. 12 is a diagram for describing a difference of charging ratio when data voltages are applied sequentially to reduce electromagnetic interferences. FIG. 13 is a diagram illustrating a vertical stripe display defect due to the difference of charging ratio of FIG. 12.

FIG. 12 illustrates the data voltages D1, D2, D3, D4, D5, and D6 corresponding to the data pattern of FIG. 11. Referring to FIGS. 2, 11, and 12, the data driver 130 may apply the data voltages sequentially to the data lines DL1 to DLn to reduce electromagnetic interferences between the data lines DL1 to DLn. For example, for convenience of illustration and description, it is assumed that the display panel includes six pixel columns corresponding to six data lines DL1 to DL6. The data voltages D1 and D6 applied to the data lines DL1 and DL6 in the edge portions of the display panel may be output without delay and data voltages D2, D3, D4, and D5 may have a delay with the delay amount increasing toward the center of the display panel. The data voltages D3 and D4 applied to the data lines DL3 and DL4 in the center portion of the display panel may have the greater delay amounts DEL3 and DEL4 and the data voltages D2 and D5 may have the smaller delay amounts DEL2 and DEL5 than the delay amounts DEL3 and DEL4 of the data voltages D3 and D4. T1, T2, T3, T4, and T5 in FIG. 12 indicate the time intervals while the switch elements Ts in the pixels PX coupled to the respective gate lines GL1 to GLm are turned on. The area of the hashed portion represents the charging ratio or the charging time. If the data voltages D3 and D4, which are applied to the data lines of the center portion by the data driver 130, have the maximum delay amounts, the charging ratios are most deficient in the center portion and thus the display defects of the vertical stripe may be caused as illustrated in FIG. 13.

Figure 14:
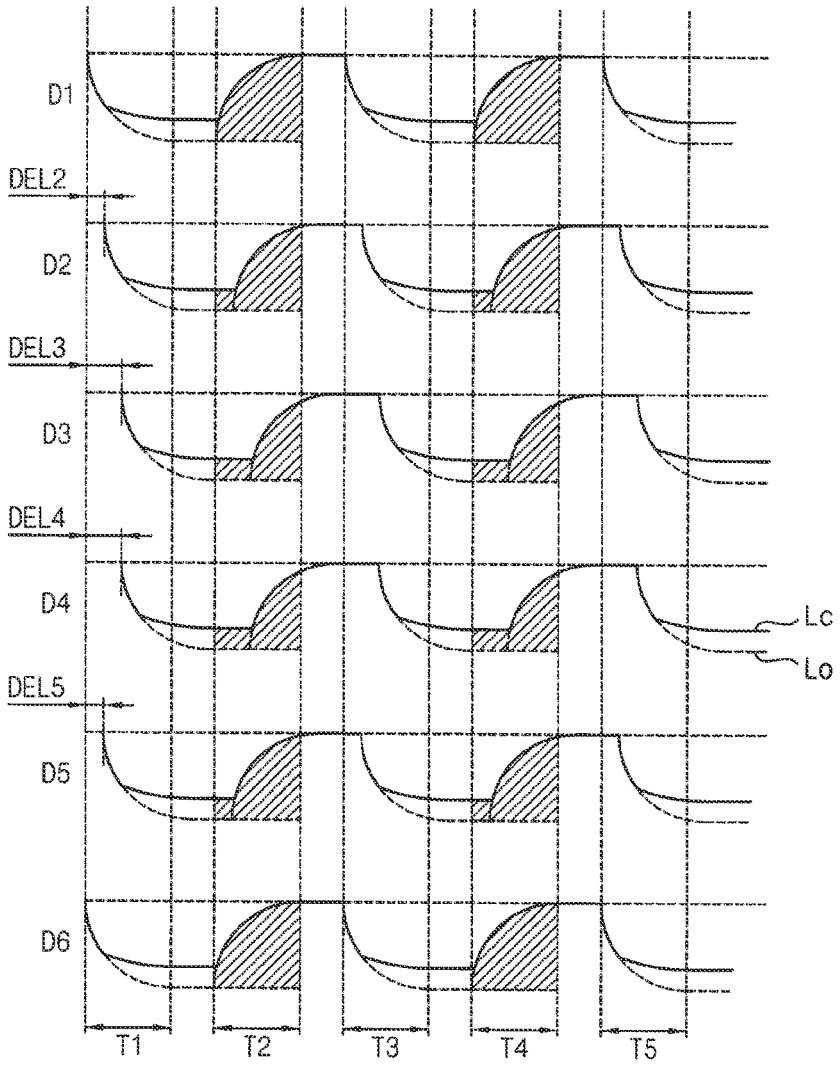
FIG. 14 is a diagram for describing compensation of a difference of charging ratio through black clipping when data voltages are applied sequentially to reduce electromagnetic interferences.

FIG. 14 is a diagram for describing compensation of a difference of charging ratio through black clipping when data voltages are applied sequentially to reduce electromagnetic interferences.

As described above, the adaptive black clipping circuit according to an exemplary embodiment detects the areal black pattern based on the input image data corresponding to a plurality of pixel rows. Accordingly the black clipping may be performed when the one isolated pixel row has the black data as illustrated in FIG. 11. In the case the data pattern of FIG. 11, the pattern detection signal PTDET from the pattern detector 500 of FIG. 7 may be deactivated and the clipping selector 600 in FIG. 3 may output the corrected image data RGB_CR corresponding to the black clipping value RGB_CL. Thus the black level Lo of the data voltages D1, D2, D3, D4, D5 and D6 are increased to the black clipping level Lc as illustrated in FIG. 14. As a result of the black clipping, the charging ratios corresponding to the data voltages D3 and D4 at the center portion are further increased and thus the difference of charging ratio may be reduced and the vertical stripe display defect as illustrated in FIG. 13 may be improved.

Figure 15:
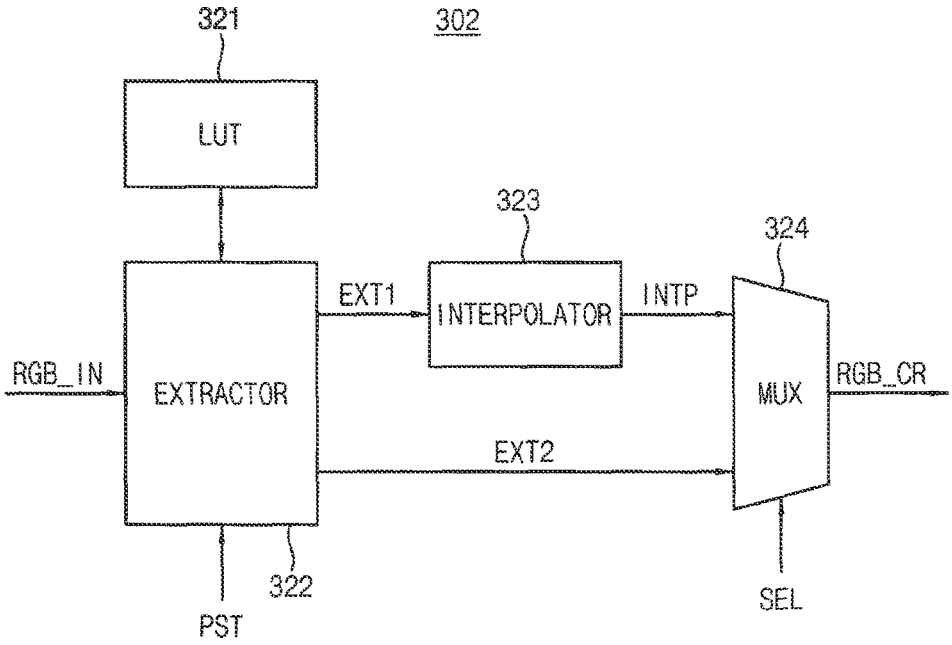
FIG. 15 is a block diagram illustrating an example of a data corrector included in the adaptive black clipping circuit of FIG. 3.

FIG. 15 is a block diagram illustrating an exemplary data collected 302 of a data corrector 300 included in the adaptive black clipping circuit of FIG. 3. FIG. 16 is a diagram illustrating an exemplary lookup table included in the data corrector 302 of FIG. 15.

Referring to FIG. 15, the data corrector 302 may include a lookup table (LUT) 321, an extractor 322, an interpolator 323, and an output selector (MUX) 324. The lookup table 321 may store corrected grayscale values respectively corresponding to grayscale values. The extractor 322 may extract a first extraction value EXT1 or a second extraction value EXT2 from the lookup table 321 based on position information PST indicating a position of the input image data RGB_IN on a display panel 110. The first extraction value EXT1 corresponds to the grayscale value of zero of the input image data RGB_IN and the second extraction value EXT2 corresponds to the grayscale value other than zero of the input image data RGB_IN. The interpolator 323 may generate an interpolation value INTP based on the first extraction value EXT1. The output selector 324 may select one of the interpolation value INTP and the second extraction value EXT2 in response to a selection signal SEL to output the corrected image data RGB_CR. The position information PST may indicate the pixel row (or the gate line) and the pixel column (or the data line) corresponding to the input image data RGB_IN currently received. The selection signal SEL may be the first detection signal PTDETc as described with reference to FIG. 7.

FIG. 16 illustrates the corrected grayscale values OUT corresponding to the grayscale values IN from 0 to 255 using 8-bit data. The black clipping value RGB_CL among the corrected grayscale values OUT may include a plurality of regional black clipping values RGB_CL1 to RGB_CLn respectively corresponding to a plurality of clipping regions CREG1 to CREGn on a display panel 110. Each of the other corrected grayscale values RGB1 to RGB255, except the black clipping value RGB_CL among the corrected grayscale values OUT, may be common with respect to all positions on the display panel 110.

As illustrated in FIG. 16, the black clipping value RGB_CF may include red regional black clipping values R_CL1 to R_CLn corresponding to the grayscale value of zero of red input image data R_IN, green regional black clipping values G_CL1 to G_CLn corresponding to the grayscale value of zero of green input image data G_IN, and blue regional black clipping values B_CL1 to B_CLn corresponding to the grayscale value of zero of blue input image data B_CL. The red black clipping value R_CLn, the green black clipping value G_n and the blue black clipping value B_CLn corresponding to each clipping region CREGn may be set to the same value or different values depending on operational characteristics of the color pixels.

FIG. 17 is a diagram for describing an interpolating method with a plurality of clipping regions.

In an exemplary embodiment, positions on the display panel may be divided into a plurality of clipping regions and a plurality of intermediate regions between the clipping regions. FIG. 17 illustrates an exemplary embodiment where the display panel is divided into first, second, third, fourth, fifth, sixth, seventh, eighth, and ninth clipping regions CREG1, CREG1, CREG2, CREG3, CREG4, CREG5, CREG6, CREG7, CREG8, and CREG9 and first, second, third, fourth, fifth, sixth, seventh, eighth, ninth, tenth, eleventh, twelfth, thirteenth, fourteenth, fifteenth, and sixteenth intermediate regions IREG1, IREG2, IREG3, IREG4, IREG5, IREG6, IREG7, IREG8, IREG9, IREG10, IREG11, IREG12, IREG13, IREG14, IREG15, and IREG16.

Referring to FIGS. 15, 16, and 17, when the input image data RGB_IN has the grayscale value of zero, the extractor 322 may output at least one value among the regional black clipping values RGB_CL1, RGB_CL2, RGB_CL3, RGB_CL4, RGB_CL5, RGB_CL6, RGB_CL7, RGB_CL8, and RGB_CL9 as the first extraction value EXT1 based on the position information PST.

When the position indicated by the position information PST is included in one clipping region among the clipping regions CREG1, CREG1, CREG2, CREG3, CREG4, CREG5, CREG6, CREG7, CREG8, and CREG9, the extractor may output one value corresponding to the one clipping region among the regional black clipping values RGB_CL1, RGB_CL2, RGB_CL3, RGB_CL4, RGB_CL5, RGB_CL6, RGB_CL7, RGB_CL8, and RGB_CL9 as the first extraction value EXT1 and the interpolator 323 may output the one value as the interpolation value INTP.

When the position indicated by the position information PST is included in one intermediate region of the intermediate regions IREG1, IREG2, IREG3, IREG4, IREG5, IREG6, IREG7, IREG8, IREG9, IREG10, IREG11, IREG12, IREG13, IREG14, IREG15, and IREG16 between the clipping regions CREG1, CREG1, CREG2, CREG3, CREG4, CREG5, CREG6, CREG7, CREG8, and CREG9, the extractor 322 may output two or more values corresponding to the one intermediate region among the regional black clipping values RGB_CL1, RGB_CL2, RGB_CL3, RGB_CL4, RGB_CL5, RGB_CL6, RGB_CL7, RGB_CL8, and RGB_CL9 as the first extraction value EXT1 and the interpolator 323 may interpolate the two or more values to output the interpolation value INTP.

For example, when the position information PST indicates the position in the fifth intermediate region IREG5, the extractor 322 may output the second regional black clipping value RGB_CL2, and the fifth regional clipping value RGB_CL5 as the first extraction value EXT1, and the interpolator 323 may interpolate the two values RGB_CL2 and RGB_CL5 to output the interpolation value INTP. In another example, when the position information PST indicate the position in the sixth intermediate region IREG6, the extractor 322 may output the second regional black clipping value RGB_CL2, the third regional clipping value RGB_CL3, the fifth regional clipping value RGB_CL5, and the sixth regional clipping value RGB_CL6 as the first extraction value EXT1, and the interpolator 323 may interpolate the four values RGB_CL2, RGB_3, RGB_CL5, and RGB_CL6 to output the interpolation value INTP.

When the input image data RGB_IN has the grayscale value other than zero, the extractor 322 may output one value corresponding to the grayscale value of the input image data RGB_IN among the corrected grayscale values as the second extraction value EXT2 regardless of the position of the input image data RGB_IN on the display panel 110.

As such, the size of the lookup table may be reduced and the black clipping may be performed by dividing the positions of the display panel into a plurality of clipping regions.

Figure 18:
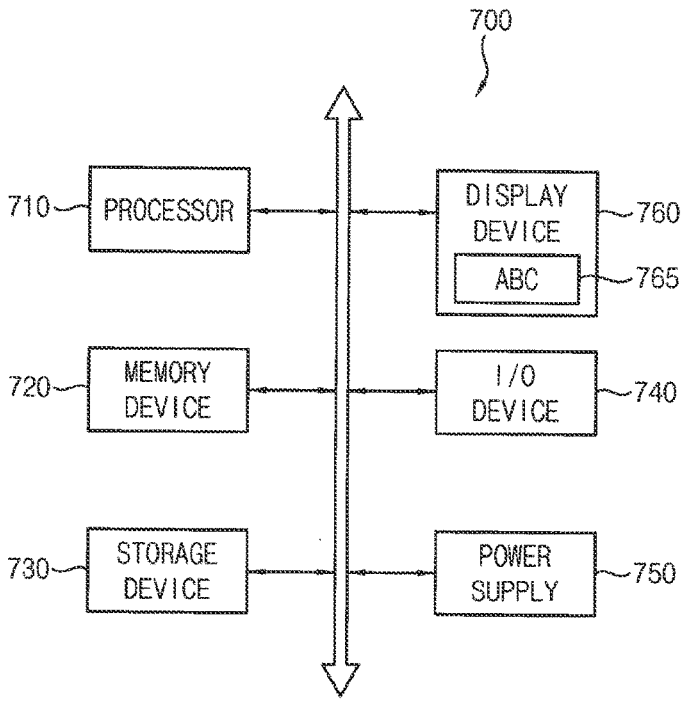
FIG. 18 is a block diagram illustrating a mobile device according to an exemplary embodiment.

FIG. 18 is a block diagram illustrating a mobile device according to an exemplary embodiment.

Referring to FIG. 18, a mobile device 700 includes a processor 710, a memory device 720, a storage device 730, an input/output (I/O) device 740, a power supply 750, and a display device 760. The mobile device 700 may further include a plurality of ports for communicating with a video card, a sound card, a memory card, a universal serial bus (USB) device, or other electronic systems.

The processor 710 may perform various computing functions or tasks. The processor 710 may be any processing unit such as a microprocessor or a central processing unit (CPU). The processor 710 may be connected to other components via an address bus, a control bus, a data bus, or the like. Further, the processor 710 may be coupled to an extended bus such as a peripheral component interconnection (PCI) bus.

The memory device 720 may store data for operations of the mobile device 700. For example, the memory device 720 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano-floating gate memory (NFGM) device, a polymer random access memory (PoRAM) device, a magnetic random access memory (MRAM) device, a ferroelectric random access memory (FRAM) device, and/or at least one volatile memory device such as a dynamic random access memory (DRAM) device, a static random access memory (SRAM) device, a mobile dynamic random access memory (mobile DRAM) device, etc.

The storage device 730 may be, for example, a solid state drive (SSD) device, a hard disk drive (HDD) device, a CD-ROM device, etc. The I/O device 740 may be, for example, an input device such as a keyboard, a keypad, a mouse, a touch screen, and/or an output device such as a printer, a speaker, etc. The power supply 750 may supply power for operating the mobile device 700. The display device 760 may communicate with other components via the buses or other communication links.

As described above with reference to FIGS. 1, 2, 3, 4, 5, 6, 7, 8, 9, 10, 11, 12, 13, 14, 15, 16, and 17, the display device 760 includes an adaptive black clipping circuit (ABC) 765 according to exemplary embodiments. The adaptive black clipping circuit 765 may detect the areal black pattern based on the input image data corresponding to a plurality of rows. Accordingly, the horizontal stripe display defect may be improved; reduction of contrast ratio due to the black clipping may be prevented. Furthermore, the vertical stripe display defect caused when data voltages are output sequentially to data lines to reduce electromagnetic interferences between the data lines may be improved.

The present embodiments may be applied to any mobile device or any computing device. For example, the present embodiments may be applied to a cellular phone, a smart phone, a tablet computer, a personal digital assistant (PDA), a portable multimedia player (PMP), a digital camera, a music player, a portable game console, a navigation system, a video phone, a personal computer (PC), a server computer, a workstation, a tablet computer, a laptop computer, etc.

Although certain exemplary embodiments and implementations have been described herein, other embodiments and modifications will be apparent from this description. Accordingly, the inventive concept is not limited to such embodiments, but rather to the broader scope of the presented claims and various obvious modifications and equivalent arrangements.

What is claimed is:

1. An adaptive black clipping circuit in a display device, comprising:

a data corrector configured to correct input image data to generate corrected image data such that the corrected image data is greater than or equal to a black clipping value, the black clipping value is greater than zero and corresponds to the input image data having a grayscale value of zero;

a register configured to store and provide configuration data;

a pattern detector configured to generate a pattern detection signal based on the input image data corresponding to a plurality of pixel rows; and a clipping selector configured to select one of the corrected image data and the configuration data in response to the pattern detection signal to provide output image data, wherein the pattern detector comprises:

a first detector configured to receive a first input image data of a current pixel row to generate a first detection signal that is activated when the first input image data is black data;

a buffer configured to receive the first input image data to output second input image data of a previous pixel row adjacent to the current pixel row;

a second detector configured to receive the second input image data to generate a second detection signal that is activated when the second input image data is black data; and a logic gate configured to perform a logic operation on the first detection signal and the second detection signal to generate the pattern detection signal that is activated when both of the first detection signal and the second detection signal are activated.

2. The adaptive black clipping circuit of claim 1, wherein the pattern detector activates the pattern detection signal when grayscale values of red input image data, green input image data, and blue input image data are zero with respect to a current pixel row and a previous pixel row adjacent to the current pixel row.

3. The adaptive black clipping circuit of claim 1, wherein the configuration data is set to a value smaller than the black clipping value.

4. The adaptive black clipping circuit of claim 1, wherein the configuration data is set to a value of zero.

5. The adaptive black clipping circuit of claim 1, wherein the data corrector comprises:

a lookup table configured to store corrected grayscale values respectively corresponding to grayscale values of the input image data; and an extractor configured to extract the corrected grayscale values corresponding to the grayscale values of the input image data from the lookup table to output the corrected image data.

6. The adaptive black clipping circuit of claim 5, wherein each of the corrected grayscale values is common with respect to all positions on a display panel.

7. The adaptive black clipping circuit of claim 6, wherein the black clipping value comprises a red black clipping value corresponding to the grayscale value of zero of a red input image data, a green black clipping value corresponding to the grayscale value of zero of a green input image data, and a blue black clipping value corresponding to the grayscale value of zero of a blue input image data.

8. The adaptive black clipping circuit of claim 1, wherein the data corrector comprises:

a lookup table configured to store corrected grayscale values respectively corresponding to grayscale values of the input image data;

an extractor configured to extract at least one of a first extraction value and a second extraction value from the lookup table based on position information indicating a position of the input image data on a display panel included in the display device, the first extraction value corresponding to the grayscale value of zero of the input image data and the second extraction value corresponding to a grayscale value other than zero of the input image data;

an interpolator configured to generate an interpolation value based on the first extraction value; and an output selector configured to select one of the interpolation value and the second extraction value in response to a selection signal to output the corrected image data.

9. The adaptive black clipping circuit of claim 8, wherein the black clipping value among the corrected grayscale values comprises a plurality of regional black clipping values respectively corresponding to a plurality of clipping regions on the display panel included in the display device.

10. The adaptive black clipping circuit of claim 9, wherein, when the input image data has the grayscale value of zero, the extractor outputs at least one value, among the regional black clipping values, as the first extraction value based on the position information.

11. The adaptive black clipping circuit of claim 10, wherein, when the position indicated by the position information is included in one clipping region among the clipping regions, the extractor outputs one value corresponding to the one clipping region among the regional black clipping values as the first extraction value and the interpolator outputs the one value as the interpolation value.

12. The adaptive black clipping circuit of claim 10, wherein, when the position indicated by the position information is included in one intermediate region between the clipping regions, the extractor outputs two or more values corresponding to the one intermediate region among the regional black clipping values as the first extraction value and the interpolator interpolates the two or more values to output as the interpolation value.

13. The adaptive black clipping circuit of claim 8, wherein each of the other corrected grayscale values except the black clipping value is common with respect to all positions on the display panel.

14. The adaptive black clipping circuit of claim 13, wherein, when the input image data has a grayscale value other than zero, the extractor outputs one value corresponding to the grayscale value of the input image data among the corrected grayscale values as the second extraction value regardless of the position of the input image data on the display panel.

15. The adaptive black clipping circuit of claim 1, wherein the first detector comprises:

a first comparator configured to generate a first comparison signal that is activated to a logic high level when red input image data of the current pixel row has a grayscale value of zero;

a second comparator configured to generate a second comparison signal that is activated to the logic high level when green input image data of the current pixel row has the grayscale value of zero;

a third comparator configured to generate a third comparison signal that is activated to the logic high level when blue input image data of the current pixel row has the grayscale value of zero; and a first AND logic gate configured to perform an AND logic operation on the first comparison signal, the second comparison signal, and the third comparison signal to generate the first detection signal.

16. The adaptive black clipping circuit of claim 15, wherein the second detector comprises:

a fourth comparator configured to generate a fourth comparison signal that is activated to the logic high level when the red input image data of the previous pixel row has the grayscale value of zero;

a fifth comparator configured to generate a fifth comparison signal that is activated to the logic high level when green input image data of the previous pixel row has the grayscale value of zero;

a sixth comparator configured to generate a sixth comparison signal that is activated to the logic high level when blue input image data of the previous pixel row has the grayscale value of zero; and a second AND logic gate configured to perform an AND logic operation on the fourth comparison signal, the fifth comparison signal, and the sixth comparison signal to generate the second detection signal.

17. A display device comprising:

a display panel comprising a plurality of pixels coupled to a plurality of data lines and a plurality of gate lines;

an adaptive black clipping circuit configured to provide output image data based on input image data;

a data driver configured to output data voltages corresponding to the output image data to the plurality of data lines; and a gate driver configured to output gate driving signals to the plurality of gate lines, wherein the adaptive black clipping circuit comprises:

a data corrector configured to correct the input image data to generate corrected image data such that the corrected image data is greater than or equal to a black clipping value, the black clipping value is greater than zero and corresponds to the input image data having a grayscale value of zero;

a register configured to store and provide configuration data;

a pattern detector configured to generate a pattern detection signal based on the input image data corresponding to a plurality of pixel rows; and a clipping selector configured to select one of the corrected image data and the configuration data in response to the pattern detection signal to provide the output image data, wherein the pattern detector comprises:

a first detector configured to receive a first input image data of a current pixel row to generate a first detection signal that is activated when the first input image data is black data;

a buffer configured to receive the first input image data to output second input image data of a previous pixel row adjacent to the current pixel row;

a second detector configured to receive the second input image data to generate a second detection signal that is activated when the second input image data is black data; and a logic gate configured to perform a logic operation on the first detection signal and the second detection signal to generate the pattern detection signal that is activated when both of the first detection signal and the second detection signal are activated.

18. The display device of claim 17, wherein the data driver delays outputting the data voltages to the plurality of data lines sequentially to reduce electromagnetic interferences between the plurality of data lines.

* * * * *